United States Patent [19]

Savoie

[11] Patent Number: 4,709,970

[45] Date of Patent: Dec. 1, 1987

[54] PORTABLE CABINET

[76] Inventor: Neil A. Savoie, 22 Pelham Rd., Hudson, N.H. 03051

[21] Appl. No.: 917,362

[22] Filed: Oct. 9, 1986

[51] Int. Cl.[4] ..... A47B 47/02

[52] U.S. Cl. ..... 312/140.4; 312/246; 312/323

[58] Field of Search ..... 312/140.4, 248, 245, 312/250, 322, 323, 246, 231, 249, 241; 248/285, 286, 287, 274, 279

[56] References Cited

U.S. PATENT DOCUMENTS

| | | | |
|---|---|---|---|
| 2,672,921 | 3/1954 | Herrick | 312/241 X |
| 4,266,835 | 5/1981 | Schmidt . | |
| 4,285,556 | 8/1981 | Loeffel . | |
| 4,378,828 | 4/1983 | Shiminski . | |
| 4,389,077 | 6/1983 | Schmidt . | |
| 4,566,325 | 1/1986 | Rante | 248/287 X |

*Primary Examiner*—Joseph Falk

*Attorney, Agent, or Firm*—Henderson & Sturm

[57] ABSTRACT

A first assembly having a floor member, first and second sidewall members connected to the floor member and a rear wall member connected to the floor member and to the first and second sidewalls. A second assembly has a top wall, third and fourth sidewalls connected to the top wall and a front wall connected to the top wall and to the third and fourth sidewalls. A hinge is provided for pivotally attaching the bottom portion of the front wall of the second assembly to a front portion of the floor member of the first assembly for permitting the second assembly to pivot between a first position closing the portable cabinet and a second position wherein the cabinet is held open. A shaft is provided having rollers on the end thereof and the second assembly has tracks thereon for mounting the shaft so that it will move toward and away from the top wall of the second assembly. A pair of arms are pivotally attached to the shaft and these arms are slidable along the length of the shaft. Projections are provided on the end of the arm for mounting the arm to a stationary object and structure is provided on the arm and on the second assembly for selectively holding the arm and shaft in one or more of a preselected positions to selectively limit movement and hold the cabinet in place.

8 Claims, 7 Drawing Figures

PORTABLE CABINET

TECHNICAL FIELD

This invention relates generally to portable cabinets, and more particularly to a portable cabinet capable of being readily opened and selectively attached to a wall or onto a horizontal surface.

BACKGROUND ART

Quite often there is a need to carry tools, spare parts, instruments, hardware, etc., from place to place and then to have access to such objects as needed. In many circumstances, there are space limitations and there are problems in getting the cabinet holding such objects close to the place where they are needed. Typically, tool boxes or other portable cabinets are utilized which are just carried from place to place and then opened or closed as needed. One of the problems is that normal tool boxes must be placed on a flat surface and quite often this turns out to be the floor wherein quite often the tool box is needed at a higher level. This is particularly true, for example, in the servicing of telephones wherein portable cabinets are typically placed on the floor and then the operator must continuously reach down to have access to the cabinet and then reach back up to have access to the telephone equipment being worked with. In certain circumstances, meters need to be used with telephones and it is extremely difficult to hold the meter and still utilize the leads to test the equipment.

Consequently, there is a need for a portable cabinet which will protect the objects therein while it is taken from place to place but which can be readily opened to hold the objects close to the place where they are needed to prevent the need to do alot of stooping over and standing up and also to free one's hands for holding objects such as meters or the like.

DISCLOSURE OF THE INVENTION

The present invention relates generally to a first assembly having a floor member, first and second sidewall members connected to the floor member and a rear wall member connected to the floor member and to the first and second sidewalls. A second assembly has a top wall, third and fourth sidewalls connected to the top wall and a front wall connected to the top wall and to the third and fourth sidewalls. A hinge is provided for pivotally attaching the bottom portion of the front wall of the second assembly to a front portion of the floor member of the first assembly for permitting the second assembly to pivot between a first position closing the portable cabinet and a second position wherein the cabinet is held open. A shaft is provided having rollers on the end thereof and the second assembly has tracks thereon for mounting the shaft so that it will move toward and away from the top wall of the second assembly. A pair of arms are pivotally attached to the shaft and these arms are slidable along the length of the shaft. Projections are provided on the end of the arm for mounting the arm to a stationary object and structure is provided on the arm and on the second assembly for selectively holding the arm and shaft in one or more of a number of preselected positions to selectively limit movement and hold the cabinet in place.

An object of the present invention is to provide an improved portable cabinet.

Another object of the present invention is to provide a portable cabinet which will protect the objects therein, but is readily mountable to either a horizontal surface or a vertical surface, while at the same time holding the objects within the cabinet in a readily accessible position.

A further object of the present invention is to provide a number of different ways to hold the cabinet in an open position while being held elevated up off of the floor.

Other objects, advantages and novel features of the present invention will become apparent from the following detailed description of the invention, when considered in conjunction with the accompanying drawings.

BEST MODE FOR CARRYING OUT THE INVENTION

Figure 1:
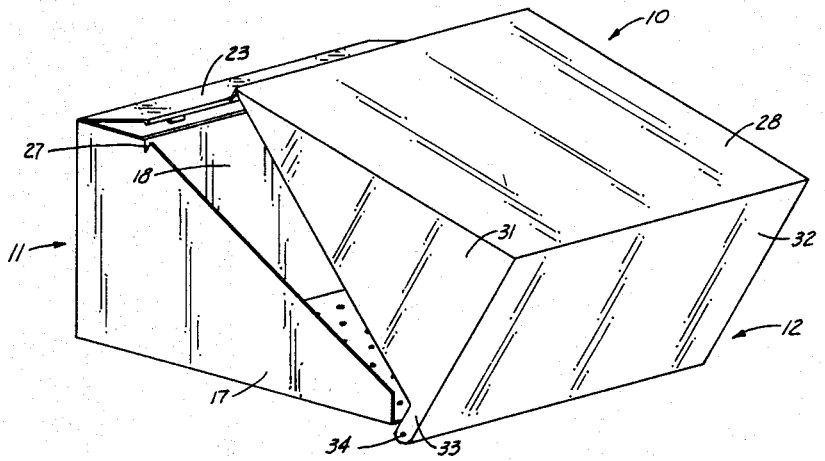
FIG. 1 is a perspective view of a preferred embodiment of the present invention showing a portable cabinet which is partially pivoted open and the lid for a compartment thereon also being lifted open to some extend.

Referring now to the drawings, wherein like reference numerals designate identical or corresponding parts throughout the several views, FIG. 1 shows a portable cabinet (10) constructed in accordance with the present invention. The portable cabinet (10) has a first assembly (11) pivotally attached to a second assembly (12). The first assembly has a floor (13) therein with a plurality of evenly spaced holes (14) therein. Sidewalls (16 and 17) are attached to the floor (13) and a rear wall (18) is attached to the floor (13) and to the sidewalls (16 and 17). An opening forming a cabinet is provided between a further rear wall (19) and the rear wall (18) and also by extensions (21 and 22). A lid (23) is provided for snapping onto the top of the compartment formed between the walls (18 and 19). Projections (24) are provided to hold the lid (23) in place, although it will be understood that other ways of attaching the lid (23) to the top of the compartment formed between walls (18 and 19) can be used.

The second assembly (12) includes a top wall (28) and sidewalls (30 and 31). A front wall (32) has a projection (33) on each end thereof and a pin (34) extends through these projections (33) and through a hinge portion (35)

attached rigidly to the floor (13) of the first assembly (11).

Figure 6:
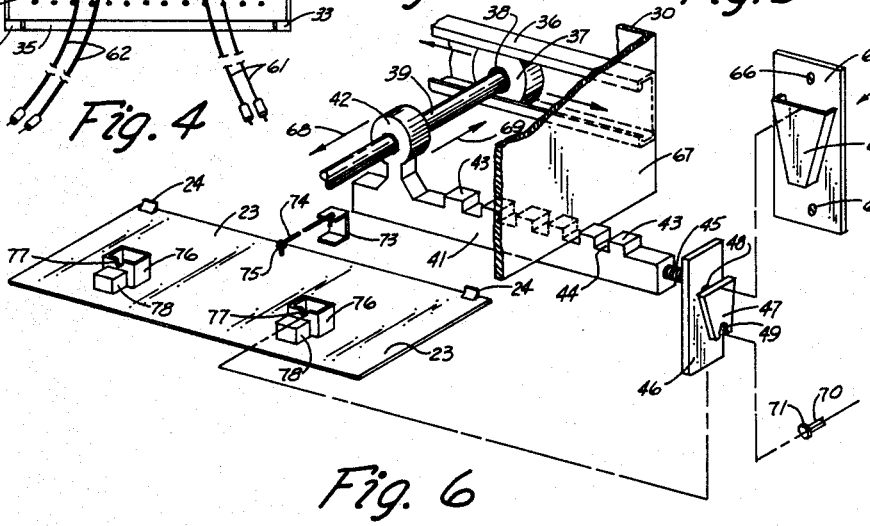
FIG. 6 is a partial exploded perspective view of the arm members to show how they are adjustable and also a perspective view of how the arm members attach onto a horizontal surface by using the lid of the cabinet, onto a wall by using a special bracket or onto a wall by attaching it to a nail.

Referring now to FIG. 6, it is noted that each of the sidewalls (30 and 31) have a track (36) attached thereto for receiving a roller (37) attached by bearings (38) onto a shaft (39).

Arms (41) are pivotally attached and slidably attached to the shaft (39) by a circular bearing portion (42). Each of the arms (41) has a plurality of projections (43) and depressions (44) thereon for reasons which will be discussed below. A threaded rod (45) is rigidly attached to a downwardly extending projection (46) on one end thereof and is threadably engaged with the arm (41) on the other end thereof so that the projection (46) can be adjusted as to its distance between the arm (41) and the projection (46). Additionally, a second downwardly extending projection (47) is attached by a post (48) to the first downwardly extending projection (46) and this second downwardly extending projection (47) has a notch (49) formed in the bottom thereof.

Figure 2:
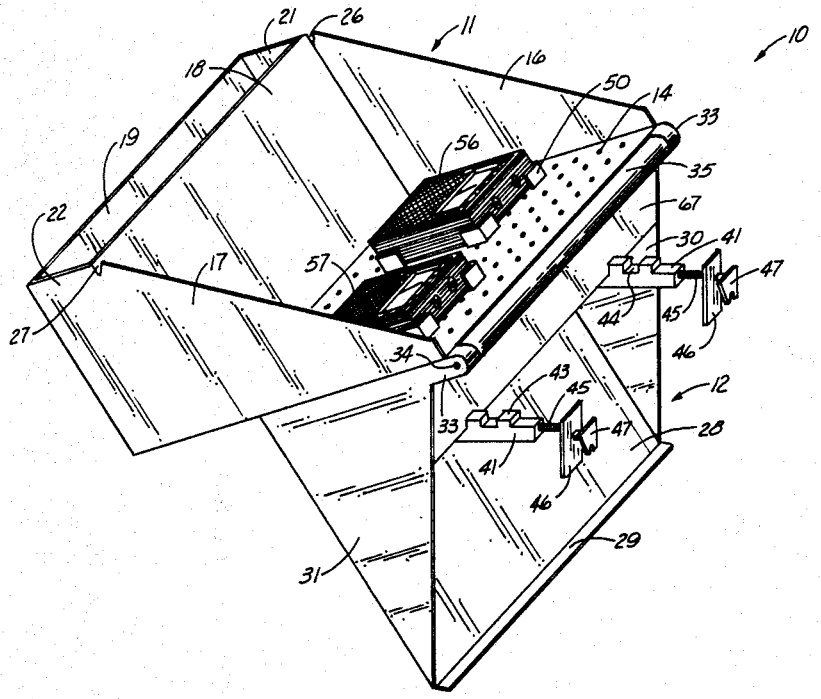
FIG. 2 is another perspective view of a preferred embodiment of the present invention showing the cabinet in an open position and in readiness to be held onto either a horizontal surface or a vertical wall.

In operation, the present invention can be utilized by placing brackets (50) having side portions (51 and 52) and downwardly extending projections (53 and 54) thereon into the openings (14) in the floor (13). When these brackets (50) are utilized, such as shown in FIGS. 2 and 4, meters such as meters (56, 57 and 58) can be held securely in place inside of the cabinet (10). Furthermore, the cabinet (10) can be closed by pivoting the first assembly (12) completely downwardly from the position shown in FIG. 1 such that the edge (29) snaps into notches (26 and 27) in walls (16 and 17), respectively. In this position then, the portable cabinet (10) can be carried from place to place, for example to a place where the meters (56, 57 and 58) are to be utilized. At that same time, leads (59, 60, 61 and 62) can be stored in the compartment between the walls (18 and 19). If it is desired to utilize the portable cabinet at one place more than others, brackets such as bracket (63) having a plate (64) attached to a somewhat V-shaped member (65) can be attached to a wall by putting threaded fasteners (66) therethrough and into a wall. If these structures (63) are utilized then the arms (41) would first be rolled from a position wherein the rollers (37) are adjacent to the rear to the top wall (28) of the second assembly (12), for example to the position shown in FIG. 6 wherein the projections (43) extend on each side of a locking wall (67). This will effectively prevent the rollers (37) from moving within the tracks (36). The arms (42) can still be slid back and forth in the direction of the arrows (68) or (69) to get the desired spacing between each of the members arms (41) to correspond to the distance between bracket (63) which are mounted on the wall. As a substitute for the bracket (63), nails (70), having a nail head (71) thereon, can be utilized by putting the notches (49) over the nails (70) to hold the portable cabinet (10) substantially in the position shown in FIG. 3, except it would be mounted on a vertical wall.

Figure 3:
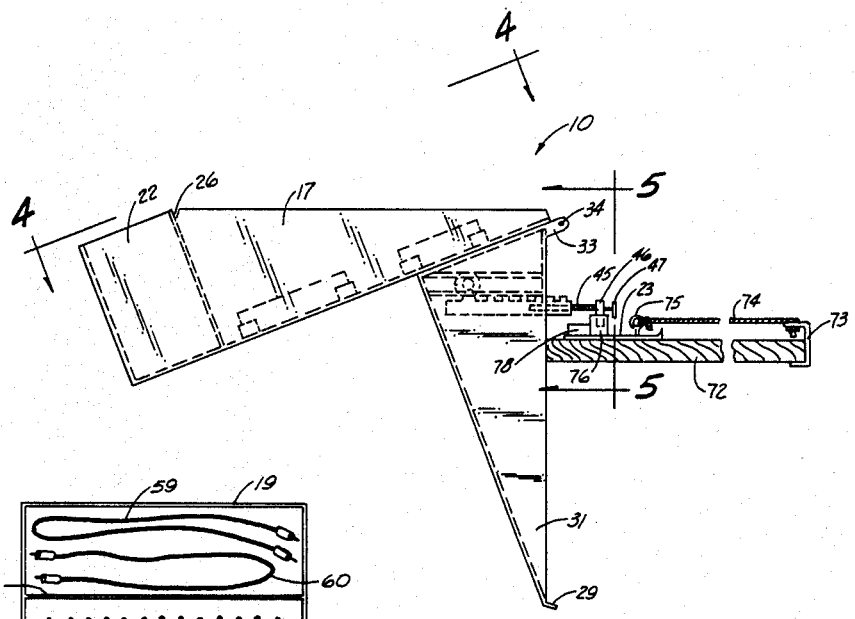
FIG. 3 is a side elevational view of the preferred embodiment of the present invention shown being held onto a horizontal work surface.
Figure 4:
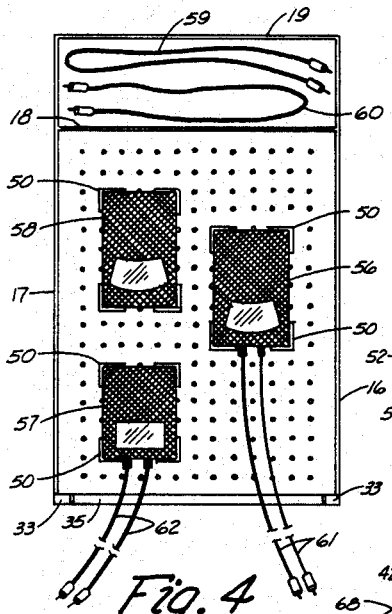
FIG. 4 is a view taken along line 4—4 of FIG. 3.
Figure 7:
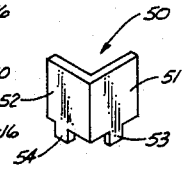
FIG. 7 is a perspective view of a bracket for attachment to the perforated floor of the cabinet for holding such things as instruments securely in place inside of the portable cabinet.
Figure 5:
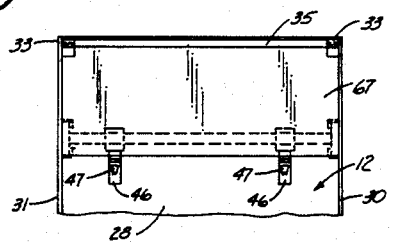
FIG. 5 is a view of the portable cabinet taken along line 5—5 of FIG. 3.

If permanent structures are not available for attachment to a wall, the lid (23) can be utilized on a desk or table top (72) for example as shown in FIGS. 3 and 6. By utilizing this structure, the lid (23) is placed top side down on top of the surface of member (72) and a hook (73) is placed over the rear of the top surface (72). A rope or an adjustable flexible line (74) is attached at one end thereof to the hook (73) and at the other end thereof to a eyelet (75) secured to the member (23). An open box-like member 76), having an open top with a slot (77) formed in the front thereof, will receive the bottom end of the downwardly extending projections (46), for example as shown in FIG. 3. The threaded rod (45) will be supported on top of a solid block (78) to further support the portable cabinet (10). Additionally, the front end of the desk or table top (72) will abut the edges of walls (30 and 31) so that the portable cabinet (10) will stay in the position shown in FIG. 3 after attachment. Once the portable cabinet (10) has been placed in the position shown in FIG. 10, the leads (61 and 62) can be removed from the storage place between the walls (18 and 19) and can be plugged into the meters (56 and 57) as shown in FIG. 4. This leaves the operator's hands free to touch the ends of the leads (61 or 62) to telephone equipment or the like without having to try to hold the meters (56 and 57) at the same time.

Consequently, it will be appreciated that the preferred embodiment shown herein does indeed accomplish the aforementioned objects. Obviously, many modifications and variations of the present invention are possible in light of the above teachings. It is therefore to be understood that, within the scope of the appended claims, the invention may be practised otherwise than as specifically described.

I claim:

1. A portable cabinet comprising:

a first assembly having a floor member, first and second sidewall members connected to the floor member and a rear wall member connected to the floor member and to said first and second sidewalls;

a second assembly having a top wall, third and fourth sidewalls connected to said top wall and a front wall connected to said top wall and to said third and fourth sidewalls;

means for pivotally attaching a bottom portion of said front wall of the second assembly to a front portion of the floor member of said first assembly for permitting said second assembly to pivot between a first position closing the portable cabinet and a second position wherein the cabinet is open;

a shaft;

means for selectively movably attaching said shaft to the third and fourth sidewalls of said second assembly for permitting said shaft to move in a first direction towards or away from said top wall;

an arm;

means for slidably attaching one end of said arm onto said shaft whereby said arm is movable in a second direction which is perpendicular to the first direction of movement of said shaft;

means for selectively attaching the other end of said arm to a stationary object; and means attached to said second assembly for selectively holding said arm and shaft in one of a number of pre-selected positions to selectively limit movement of said second assembly relative to said arm and shaft in said first direction; wherein, said means attached to said second assembly includes a downwardly extending projection connected to the other end of said arm and a threaded rod means connects said downwardly extending projection to said arm for extending or shortening the effective length of said arm.

2. The portable cabinet of claim 1 including compartment means connected to the rear wall member of said first assembly for storing objects; a lid adapted to cover said compartment means and means attached to said lid for receivably holding said downwardly extending projection when said second assembly is in the second position thereof and said lid is disposed onto a horizontal surface.

3. The portable cabinet of claim 2 wherein said holding means further includes structure wherein said arm member has a plurality of depressions and protuberances thereon and said second assembly has means thereon for mating with selected ones of said depressions and protuberances for selectively holding said arm means from moving in said first direction when the mating means is engaged with said depressions and protuberances.

4. The portable cabinet of claim 3 including a second downwardly extending projection attached to said first downwardly extending projection and means adapted to be attached to a wall for receivably holding said second downwardly extending projection.

5. The portable cabinet of claim 4 wherein said second downwardly extending projection has a notch means for selectively receivably holding a nail attached to a wall.

6. The portable cabinet of claim 5 including a second arm identical in all respects to the first arm is slidably attached to said shaft.

7. The portable cabinet of claim 6 wherein said lid includes a second means for receivably holding a second downwardly extending projection on said second arm when said second assembly is in the second position thereof and said lid is disposed onto a horizontal surface.

8. The portable cabinet of claim 1 wherein said floor member has a plurality of spaced apart holes therein and a plurality of brackets having projections thereon are attached to said floor member by having the projections thereon extending into said holes, whereby electronic meters can be held in place by said brackets.

* * * * *

UNITED STATES PATENT AND TRADEMARK OFFICE

CERTIFICATE OF CORRECTION

PATENT NO. : 4,709,970

DATED : December 1, 1987

INVENTOR(S) : Neri A. Savoie

It is certified that error appears in the above—identified patent and that said Letters Patent is hereby corrected as shown below:

On the Title Page, Item [76] should read:
Inventor: NERI A. SAVOIE

Signed and Sealed this

Seventeenth Day of May, 1988

*Attest:*

DONALD J. QUIGG

*Attesting Officer*

*Commissioner of Patents and Trademarks*